US007370495B2

(12) United States Patent
Johnson

(10) Patent No.: US 7,370,495 B2
(45) Date of Patent: May 13, 2008

(54) CLOTHES WASHER TEMPERATURE CONTROL APPARATUS AND METHOD

(75) Inventor: Ronald Miles Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 656 days.

(21) Appl. No.: 10/600,950

(22) Filed: Jun. 20, 2003

(65) Prior Publication Data

US 2004/0255392 A1 Dec. 23, 2004

(51) Int. Cl.
*D06F 33/04* (2006.01)

(52) U.S. Cl. ..... 68/12.02; 68/12.03; 68/12.22

(58) Field of Classification Search ..... 68/12.03, 68/12.21, 207
See application file for complete search history.

(56) References Cited

U.S. PATENT DOCUMENTS 1,779,937 A * 10/1930 Holinger ..... 122/4 R
2,302,923 A * 11/1942 Zimarik ..... 137/387
2,346,259 A * 4/1944 Hutchings ..... 68/12.22
2,355,162 A * 8/1944 Hovey ..... 68/12.21
3,553,483 A * 1/1971 Jarvis ..... 307/141
4,031,911 A 6/1977 Frazar
4,147,297 A * 4/1979 Worst ..... 236/12.12
4,330,081 A * 5/1982 McMillan ..... 236/12.1
4,406,401 A 9/1983 Nettro
4,455,701 A * 6/1984 Stehr et al. ..... 8/158
4,528,709 A * 7/1985 Getz et al. ..... 8/158
4,643,350 A * 2/1987 DeSchaaf et al. ..... 236/12.12
4,662,193 A * 5/1987 Honda ..... 68/12.05
4,978,058 A * 12/1990 Duncan et al. ..... 236/12.12
5,255,844 A * 10/1993 Miller et al. ..... 236/12.12
5,299,340 A * 4/1994 Moon ..... 8/158
5,439,019 A * 8/1995 Quandt et al. ..... 137/2
5,873,518 A * 2/1999 Richmond et al. ..... 236/12.12
5,978,995 A 11/1999 Bruntz et al.
6,003,182 A * 12/1999 Song ..... 8/158
6,125,490 A 10/2000 Riechman et al.
6,305,610 B1 10/2001 Estes
6,327,730 B1 * 12/2001 Corbett ..... 8/158
6,553,594 B2 * 4/2003 Broker et al. ..... 8/158
6,935,142 B2 * 8/2005 Musser et al. ..... 68/12.16

FOREIGN PATENT DOCUMENTS

JP 61-244394 * 10/1986
JP 3-237997 * 10/1991

(Continued)

*Primary Examiner*—Frankie L. Stinson
(74) *Attorney, Agent, or Firm*—George L. Rideout, Esq.; Armstrong Teasdale LLP

(57) ABSTRACT

A temperature control for a washing machine that includes a tub and hot and cold water valves is provided. The temperature control includes a first pressure sensor positioned to sense a full fill level in the tub and configured to generate a full fill signal when the tub is full and a second pressure sensor positioned to sense an intermediate fill level, less than full, in the tub and configured to generate an intermediate fill signal when the intermediate fill level is reached. A controller is operatively coupled to the first and second pressure sensors and the hot and cold water valves. The controller is operable to control the valves based on the fill signals from the pressure sensors to control a wash water temperature.

13 Claims, 7 Drawing Sheets

FOREIGN PATENT DOCUMENTS

| | | |
|---|---|---|
| JP | 4-325192 | * 11/1992 |
| JP | 4-325195 | * 11/1992 |
| JP | 5-76684 | * 3/1993 |
| JP | 5-285293 | * 11/1993 |
| JP | 6-79090 | * 3/1994 |
| JP | 7-148386 | * 6/1995 |
| KR | 2001098082 | * 11/2001 |
| KR | 2003008350 | * 1/2003 |

* cited by examiner

CLOTHES WASHER TEMPERATURE CONTROL APPARATUS AND METHOD

BACKGROUND OF THE INVENTION

This invention relates generally to washing machines, and more particularly, to methods and apparatus for controlling wash water temperatures.

Washing machines typically include a cabinet that houses an outer tub for containing wash and rinse water, a perforated clothes basket within the tub, and an agitator within the basket. A drive and motor assembly is mounted underneath the stationary outer tub to rotate the basket and the agitator relative to one another, and a pump assembly pumps water from the tub to a drain to execute a wash cycle. See, for example, U.S. Pat. No. 6,029,298.

At least some known washing machines provide that an operator can select from three wash temperatures. Such machines have valve systems including hot and cold water valves. For a hot wash operation, for example, the hot water valve is turned on, i.e., opened, and for a cold wash operation, the cold valve is opened. For a warm wash, both the hot valve and cold valve are opened. The flow rates of water through the valves is selected so that the desired warm temperature is achieved using hot and cold water.

Reducing the energy a washing machine uses is desirable. One way to reduce the energy used by washing machines is to reduce hot water usage. Reducing hot water usage in a washing machine facilitates reducing energy consumption by the machine during wash operations.

BRIEF DESCRIPTION OF THE INVENTION

In one aspect, a temperature control for a washing machine that includes a tub and hot and cold water valves is provided. The temperature control includes a first pressure sensor positioned to sense a full fill level in the tub and configured to generate a full fill signal when the tub is full and a second pressure sensor positioned to sense an intermediate fill level, less than full, in the tub and configured to generate an intermediate fill signal when the intermediate fill level is reached. A controller is operatively coupled to the first and second pressure sensors and the hot and cold water valves. The controller is operable to control the valves based on the fill signals from the pressure sensors to control a wash water temperature.

In another aspect, a washing machine is provided that includes a tub, a cold water valve for controlling flow of cold water to the tub, and a hot water valve for controlling flow of hot water to the tub. A first pressure sensor is positioned to sense a full fill level in the tub and configured to generate a full fill signal when the tub is full. A second pressure sensor positioned to sense an intermediate fill level, less than full, in the tub and configured to generate an intermediate fill signal when the intermediate fill level is reached. A controller operatively coupled to the first and second pressure sensors and the hot and cold water valves. The controller is operable to control the valves based on the fill signals from the pressure sensors to control a wash water temperature.

In another aspect, a method for controlling a washing machine during a hot fill cycle is provided, the washing machine including a hot water valve, a cold water valve, a first pressure sensor sensing a full fill condition, and a second pressure sensor sensing a predetermined intermediate fill condition. The method includes setting a default mix ratio for the hot and cold water valves based on a desired warm fill temperature and starting the fill with the hot and cold valves at the default mix ratio, turning off the cold valve when the intermediate fill condition is reached, and continuing the fill with the hot valve turned on until a full fill condition is reached, then turning off the hot valve.

In an alternative embodiment, a method for controlling a washing machine during a warm fill includes, setting a default mix ratio for the hot and cold water valves based on a desired hot fill temperature, starting the fill with the hot and cold valves at the default mix ratio, turning off the hot valve when the intermediate fill condition is reached, and continuing the fill with the cold valve turned on until a full fill condition is reached, then turning off the cold valve.

DETAILED DESCRIPTION OF THE INVENTION

Figure 1:
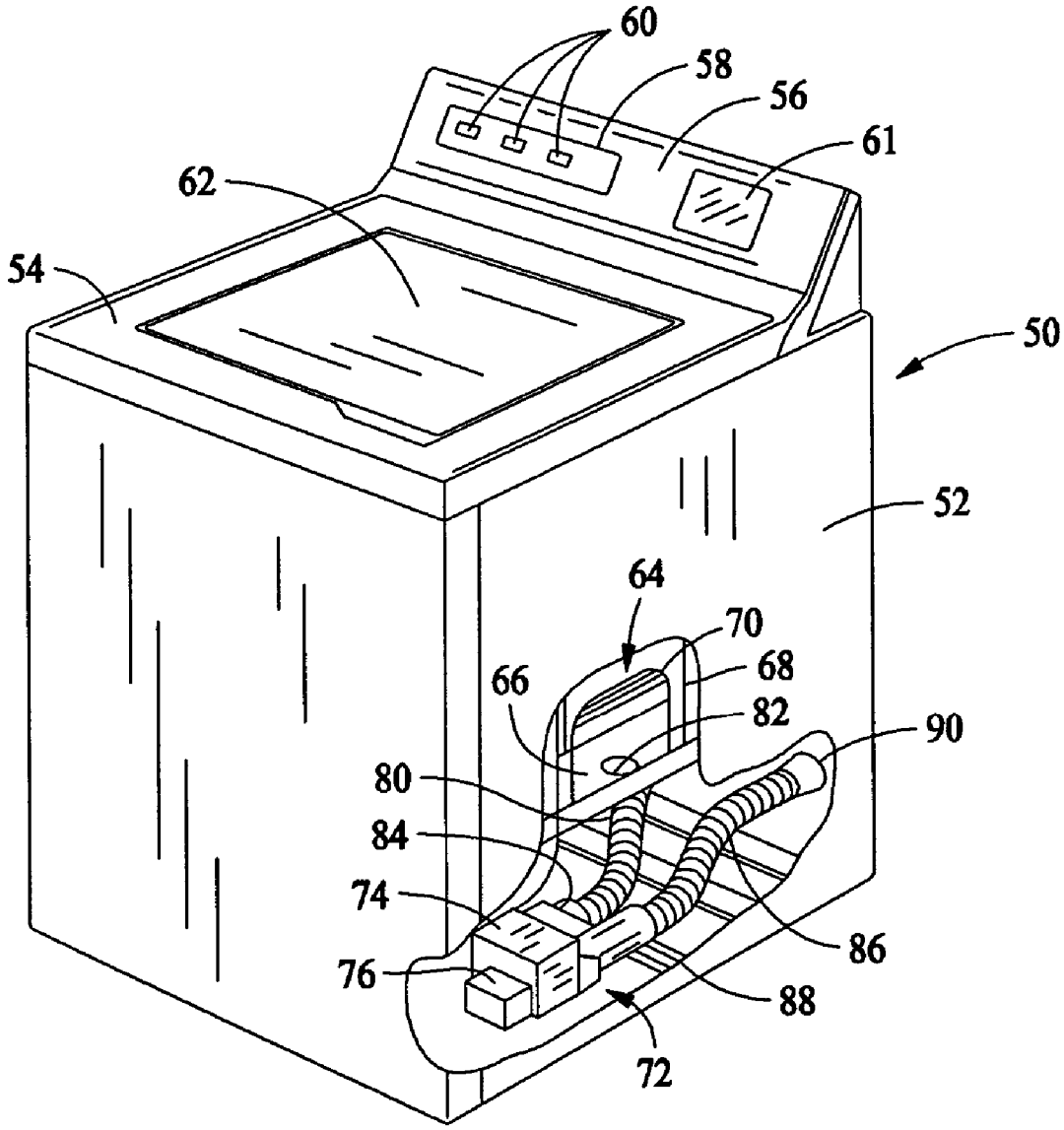
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and, in one embodiment, a display 61 indicates selected features, a countdown timer, and other items of interest to users. A lid 62 is mounted to cover 54 and is rotatable about a hinge (not shown) between an open position (not shown) facilitating access to a wash tub 64 located within cabinet 52, and a closed position (shown in FIG. 1) forming a substantially sealed enclosure over wash tub 64. As illustrated in FIG. 1, machine 50 is a vertical axis washing machine. It is contemplated that the benefits of the invention accrue to other types of washing machines, including, but not limited to, horizontal axis machines.

Tub 64 includes a bottom wall 66 and a sidewall 68, arid a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
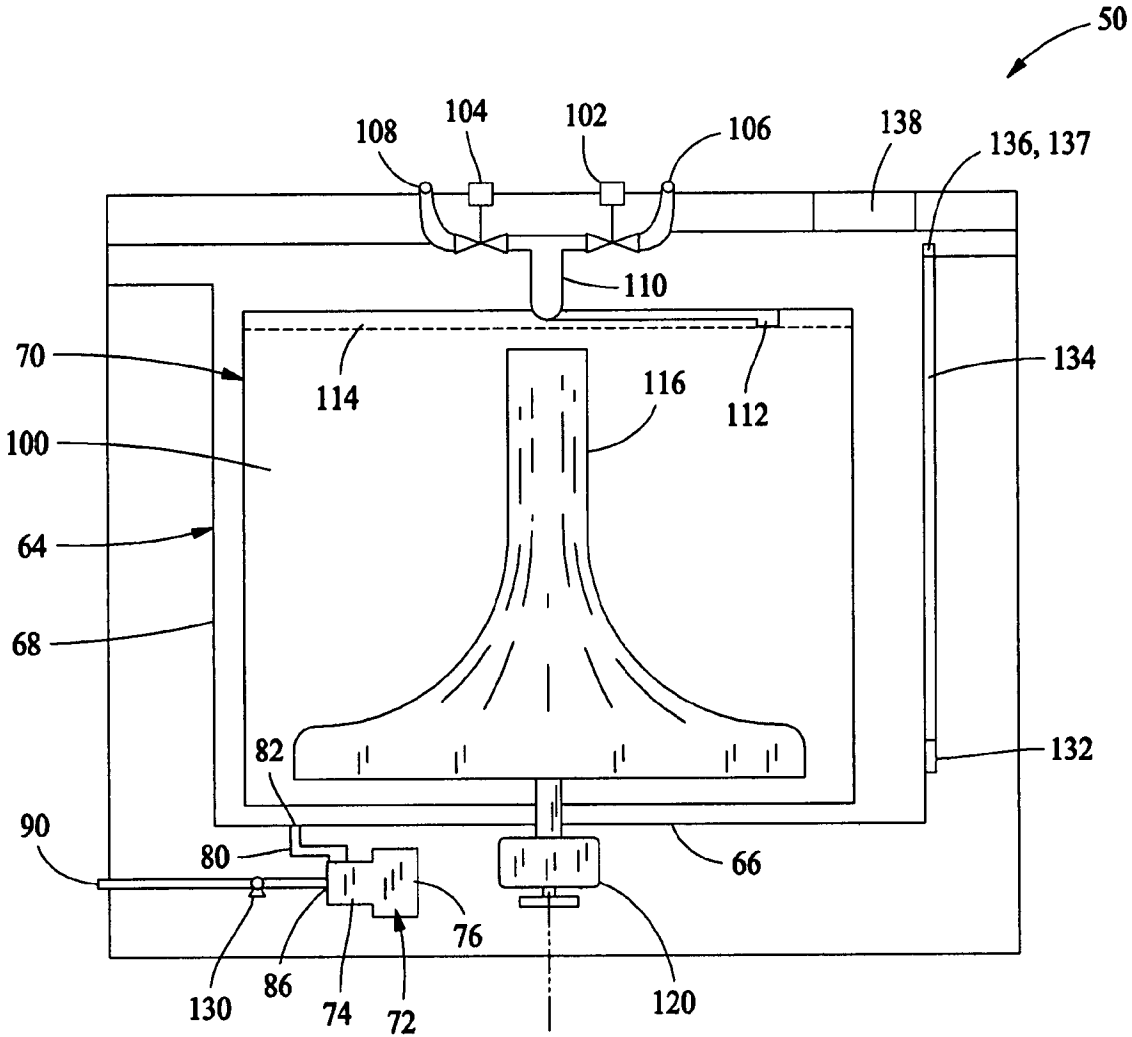
FIG. 2 is front elevational schematic view of the washing machine shown in FIG. 1.

FIG. 2 is a front elevational schematic view of washing machine 50 including wash basket 70 rotatably mounted in wash tub 64 in a spaced apart relationship from tub side wall 64 and tub bottom 66. Basket 12 includes a plurality of perforations therein to facilitate fluid communication between an interior of basket 70 and wash tub 64.

A hot water valve 102 and a cold water valve 104 deliver fluid to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. Basket 70 and agitator 116 are driven by motor 120.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and pressure sensors 136 and 137. As fluid levels rise in wash tub 64, air is trapped in reservoir 132 creating a pressure in tube 134 that pressure sensors 136 and 137 monitor. Liquid levels, and more specifically, changes in liquid levels in wash tub 64 may therefore be sensed, for example, to indicate laundry loads and to facilitate associated control decisions such as the control of hot and cold water valves 102 and 104 during fill operations. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

Figure 3:
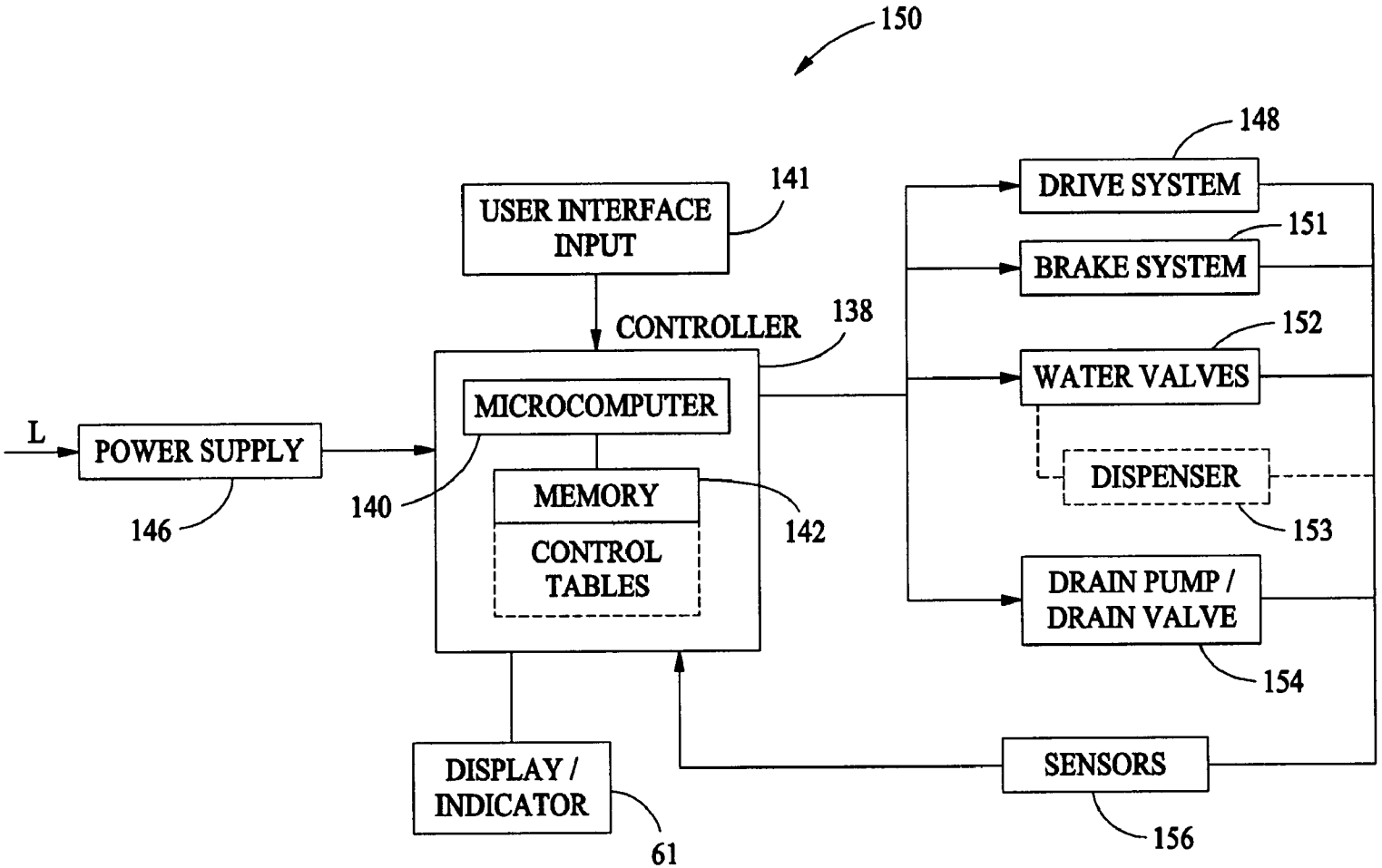
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. As used herein, the term controller is not limited to just those integrated circuits referred to in the art as controllers, but broadly refers to microprocessors, computers, processors, microcontrollers, microcomputers, programmable logic controllers, application specific integrated circuits, field programmable gate arrays, and other programmable circuits, and these terms are used interchangeably herein. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washer users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146. Controller 138 is operatively coupled to machine drive system 148 (e.g., motor 120 and agitation element 116 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or another composition of benefit to washing of articles in wash basket 70.

In response to manipulation of user interface input 141, controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein.

To facilitate reducing energy consumption, washing machine 50 utilizes at least some cold water for a hot wash operation. That is, by adding cold water for a hot wash operation, a water level for the hot wash is achieved while using less hot water than is used if all water used were hot water. Controller 138 implements the herein described methods.

To alter the cold/hot water mix during fill operations, washing machine 50 alters a fill operation based on signals from pressure sensors 136 and 137. One sensor, such as sensor 136 is used to sense a full tub condition and signals controller 138 to turn off both hot and cold water valves 102 and 104. The second pressure sensor 137 senses a predetermined intermediate water level that is less than the full level and corresponds to the level at which an adjustment in the hot and cold water mix is made to reduce hot water usage. Pressure sensors 136 and 137 may be independent pressure sensors or they may be combined in one pressure sensor that has multiple trip points.

In a process flow descriptions that follow, P1 is used to refer to one of sensors 136 and 137 that is set to sense a full tub condition, while P2 refers to the other of pressure sensors 136 and 137 that is set to sense a predetermined water level that is less than full. The hot and cold water mix is determined only by pressure monitoring and without the aid of temperature sensors. Hot and cold water valves 102 and 104 each has an off position and a single on position. The on positions for each valve 102 and 104 are preset to achieve a desired temperature for a default fill condition, either warm or hot, that represents the type of fill that results when the tub is filled completely, e.g. a full fill, with valves 102 and 104 both turned on and with no intermediate adjustment. Cold, warm, and hot water fill options are available for user selection.

Figure 4:
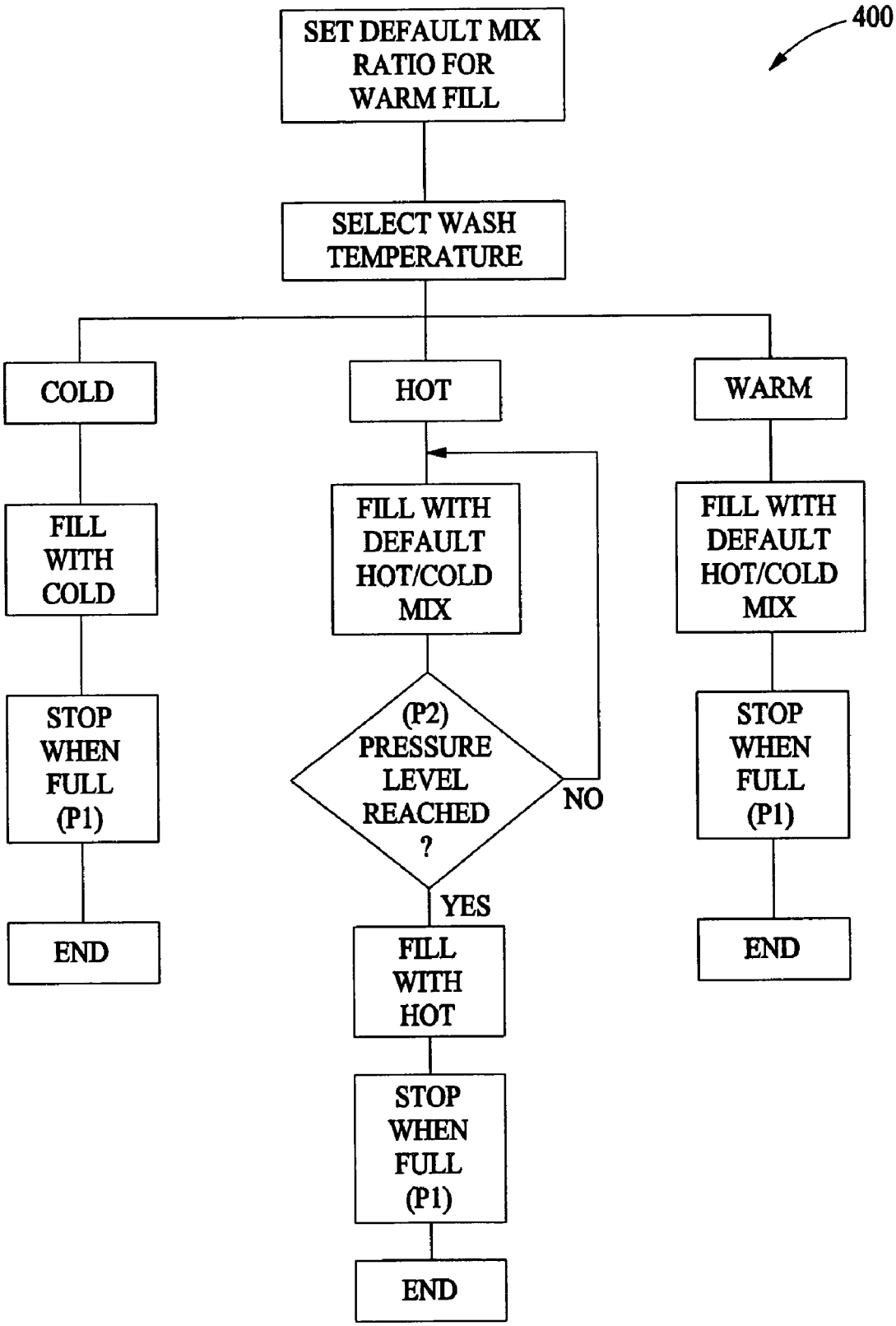
FIG. 4 is a flow diagram illustrating one method of pressure sensor based temperature control.

FIG. 4 is a process flow diagram illustrating one method 400 for reducing the hot water used in a fill operation, particularly a hot water fill operation. In method 400, a default mix ratio for hot and cold water valves 102 and 104 is established such that when the valves are in the default positions, a warm fill is achieved. For a cold water fill, tub 64 is filled just with cold water, e.g. cold valve 104 on, and hot valve 102 off. Controller 138 closes all valves when sensor P1 signals that tub 64 is full.

For a warm water fill, hot and cold valves 102 and 104 are both opened or turned on, and since a warm fill is the default condition, both valves 102 and 104 remain on for the duration of the fill until controller 138 closes all valves in response to a full signal from sensor P1.

For a hot water fill, filling starts with both hot and cold valves 102 and 104 and turned on. When a predetermined water level is reached, as indicated by a signal from sensor P2, controller 138 closes the cold valve 104 and continues the fill with only the hot valve 102 turned on. Controller 138 closes all valves when sensor P1 signals that tub 64 is full. Thus for a hot water fill, tub 64 is partially filled with warm water, as opposed to a complete fill with hot water, thereby reducing hot water usage.

Figure 5:
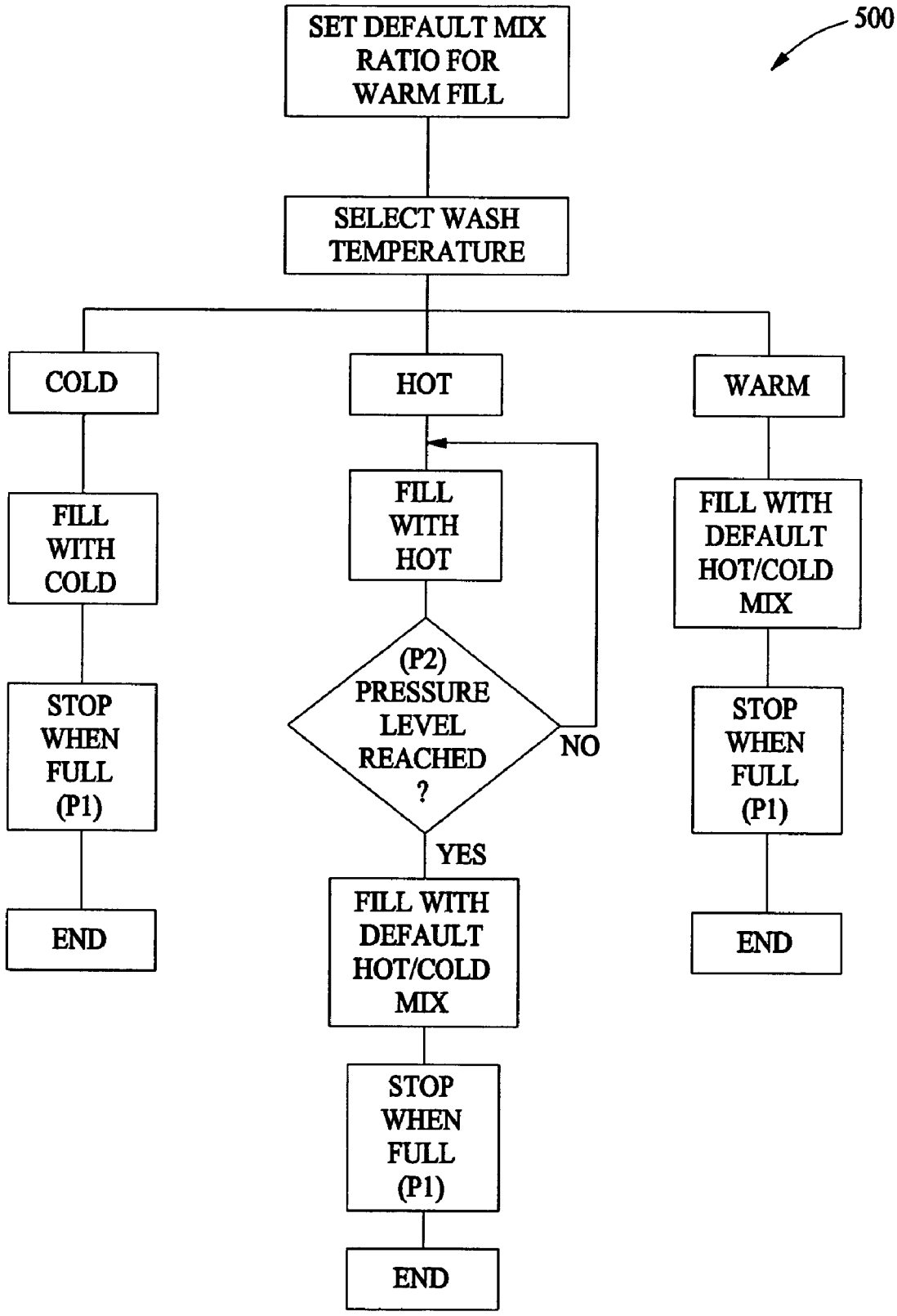
FIG. 5 is a flow diagram illustrating an alternative method of pressure sensor based temperature control.

FIG. 5 is a process flow diagram illustrating an alternative method 500 for reducing the hot water used in a hot water fill. In method 500, a default mix ratio for hot and cold water valves 102 and 104 is established such that when the valves are in the default positions, a warm fill is achieved. For a cold fill, tub 64 is filled just with cold water, e.g. cold valve 104 on, and hot valve 102 off. Controller 138 closes all valves when sensor P1 signals that tub 64 is full.

For a warm water fill, hot and cold valves 102 and 104 are both opened or turned on, and since a warm water fill is the default condition, both valves 102 and 104 remain on for the duration of the fill until controller closes all valves in response to a full signal from sensor P1.

For a hot water fill, filling starts hot valve 102 and turned on. When a predetermined water level is reached, as indicated by a signal from sensor P2, controller 138 opens the cold valve 104 and continues the fill with both hot and cold water from valves 102 and 104 turned on at the default mix ratio which is a warm water fill. Controller 138 closes all valves when sensor P1 signals that tub 64 is full. Thus for a hot water fill, tub 64 is again partially filled with warm water, as opposed to a complete fill with hot water, thereby reducing hot water usage.

Figure 6:
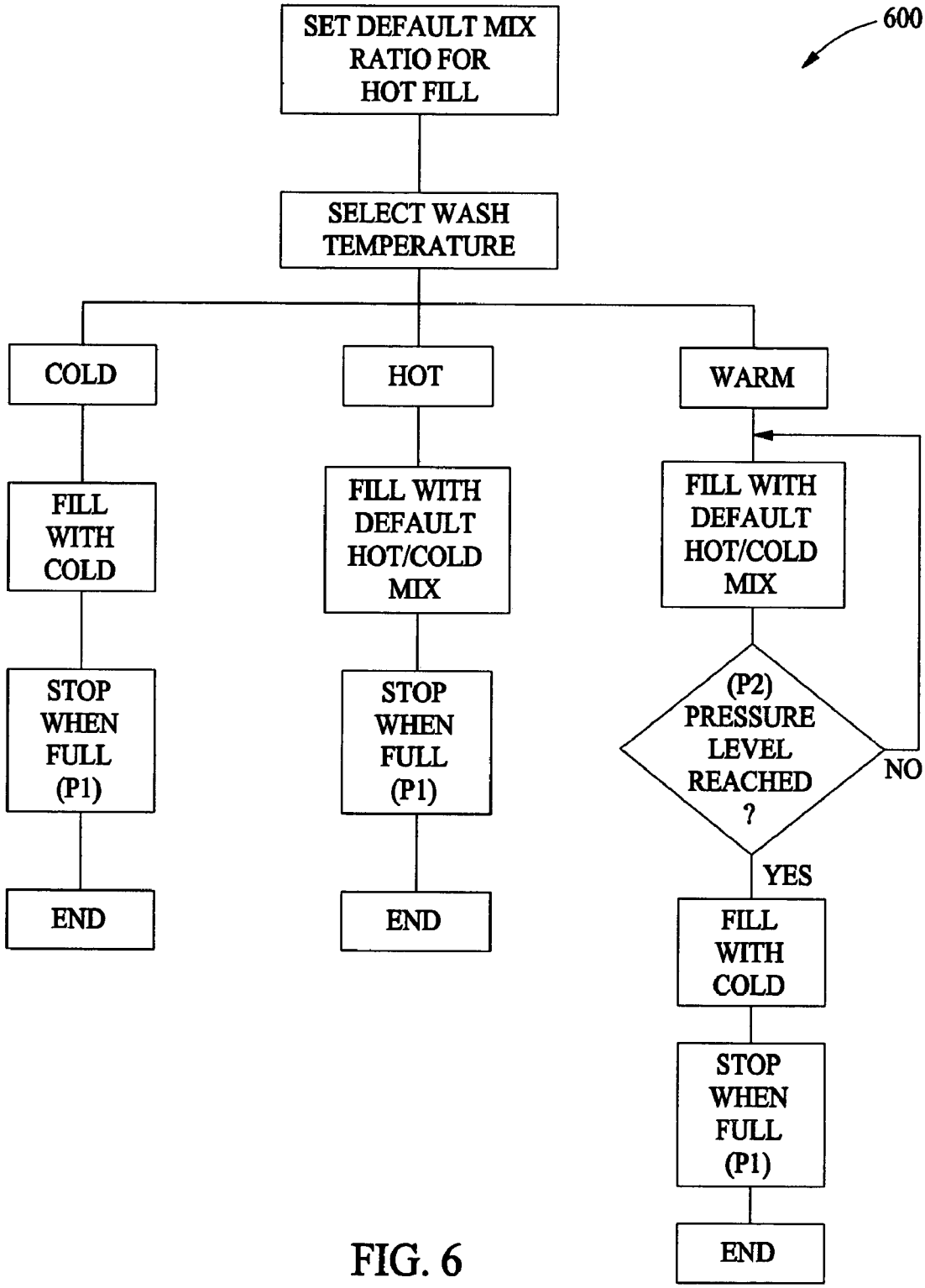
FIG. 6 is a flow diagram illustrating another alternative method of pressure sensor based temperature control.

FIG. 6 is a process flow diagram illustrating another embodiment of a method 600 for reducing the hot water used in a fill operation, particularly a hot water fill operation. In method 600, a default mix ratio for hot and cold water valves 102 and 104 is established such that when the valves are in the default positions, a hot fill is achieved. For a cold water fill, tub 64 is filled just with cold water, e.g. cold valve 104 on, and hot valve 102 off, as in methods 400 and 500 previously described. Controller 138 closes all valves when sensor P1 signals that tub 64 is full.

For a warm water fill, hot and cold valves 102 and 104 are both opened or turned on at the default mix ratio. However, since the default fill condition is for a hot water fill, an adjustment is made at the intermediate fill level. When the predetermined intermediate water level is reached, as indicated by a signal from sensor P2, controller 138 closes the hot valve 102 and continues the fill with only the cold valve 104 turned on to achieve a warm water fill. Controller 138 closes all valves when sensor P1 signals that tub 64 is full.

For a hot water fill, filling starts with both hot and cold valves 102 and 104, and since a hot water fill is the default condition, both valves 102 and 104 remain on for the duration of the fill until controller closes all valves in response to a full signal from sensor P1. Thus for a hot water fill, tub 64 is filled with a preset mix of hot and cold water, thereby reducing hot water usage.

Figure 7:
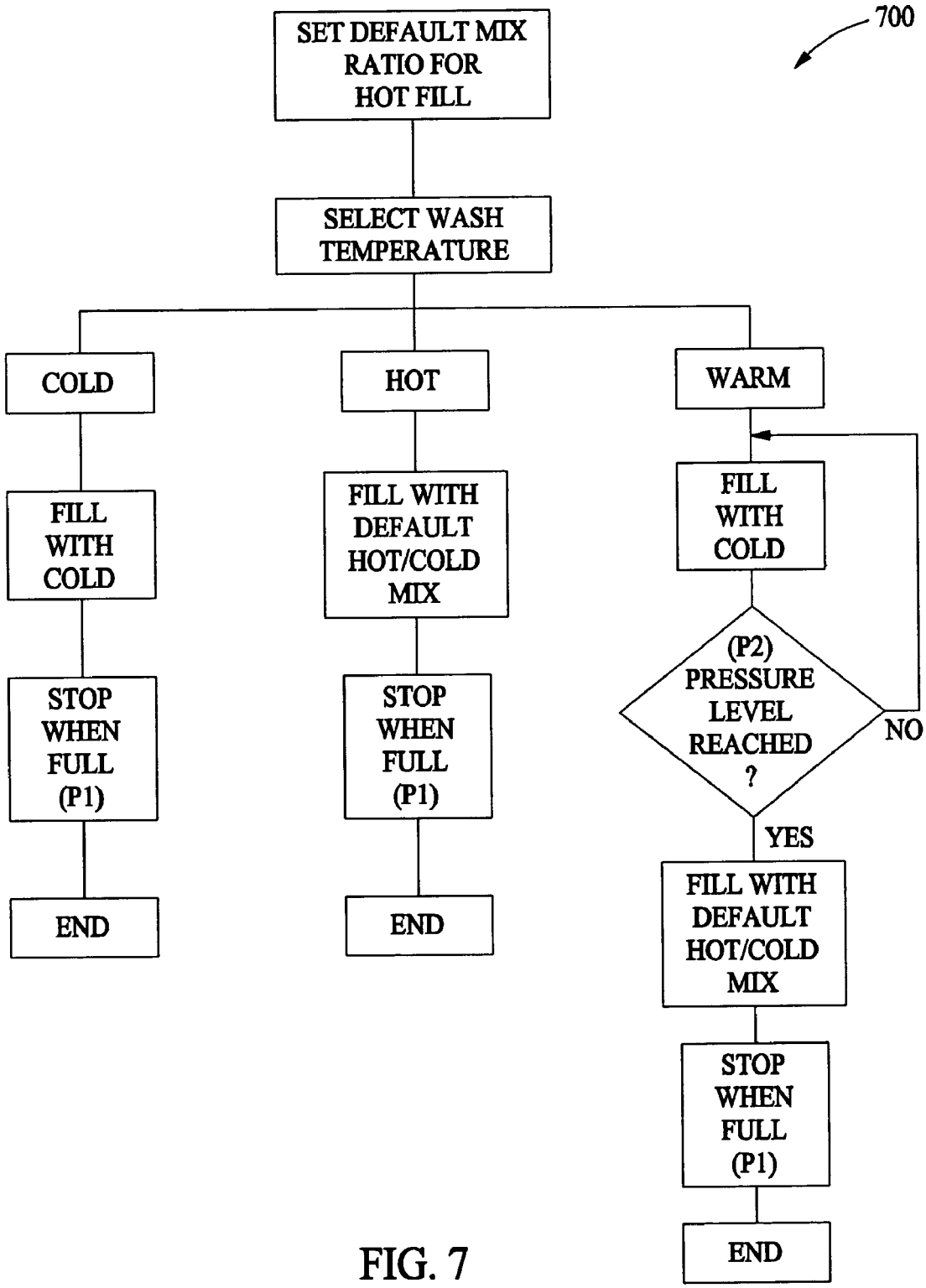
FIG. 7 is a flow diagram illustrating another alternative method of pressure sensor based temperature control.

FIG. 7 is a process flow diagram illustrating another alternative method 700 for reducing the hot water used in a hot water fill operation. In method 700, a default mix ratio for hot and cold water valves 102 and 104 is established such that when the valves are in the default positions, a hot water fill is achieved. For a cold water fill, tub 64 is filled just with cold water, e.g. cold valve 104 on, and hot valve 102 off, as in the methods previously described. Controller 138 closes all valves when sensor P1 signals that tub 64 is full.

For a warm water fill, the fill begins with cold valve 104 turned on. When the predetermined intermediate water level is reached, as indicated by a signal from sensor P2, controller 138 opens hot valve 102 and continues the fill with hot and cold valves 102 and 104 both opened or turned on at the default mix ratio which is set for a reduced temperature hot water fill. Controller 138 closes all valves when sensor P1 signals that tub 64 is full. Thus, a warm water fill is achieved by blending cold water with a reduced temperature hot water fill default condition.

For a hot water fill, filling starts with both hot and cold valves 102 and 104, and since a hot water fill is the default condition, both valves 102 and 104 remain on for the duration of the fill until controller closes all valves in response to a full signal from sensor P1. Thus for a hot water fill, tub 64 is filled with a preset mix of hot and cold water, thereby reducing hot water usage.

The above described methods are presented for example only and are not for limitations. Variations other than those described above are contemplated.

The above described control facilitates reducing hot water usage in a washing machine, which in turn facilitates reducing energy consumption by the machine during wash operations. Specifically, by reducing the use of only hot water during a hot wash fill, energy consumption of the washing machine is reduced.

While the invention has been described in terms of various specific embodiments, those skilled in the art will recognize that the invention can be practiced with modification within the spirit and scope of the claims.

What is claimed is:

1. A temperature control for a washing machine, the washing machine including a tub, a hot water valve, and a cold water valve, said temperature control comprising:

a first pressure sensor positioned to sense a full fill level in the tub and configured to generate a full fill signal when the tub is full; and a second pressure sensor positioned to sense an intermediate fill level, the intermediate fill level less than the full fill level and corresponding to an adjustment level in the tub, said second pressure sensor configured to generate an intermediate fill signal when the intermediate fill level is reached, said first pressure sensor and said second pressure sensor operatively coupled to the hot water valve and the cold water valve, said first pressure sensor generating the full fill signal and said second pressure sensor generating the intermediate fill signal to facilitate activating the hot water valve and the cold water valve in response to sensed pressure within the tub to control a wash water temperature without the aid of temperature sensors.

2. A temperature control in accordance with claim 1 wherein said second pressure sensor generating the intermediate fill signal to close the cold water valve during a hot fill operation.

3. A temperature control in accordance with claim 1 wherein said second pressure sensor generating the intermediate fill signal to open the cold water valve during a hot fill operation.

4. A temperature control in accordance with claim 3 wherein said second pressure sensor generating the intermediate fill signal to close the hot water valve during a warm fill operation.

5. A temperature control in accordance with claim 3 wherein said second pressure sensor generating the intermediate fill signal to open the hot water valve during a warm fill operation.

6. A washing machine comprising:

a tub;

a cold water valve for controlling flow of cold water to said tub;

a hot water valve for controlling flow of hot water to said tub;

a first pressure sensor positioned to sense a full fill level in said tub and configured to generate a full fill signal when said tub is full; and a second pressure sensor positioned to sense an intermediate fill level, the intermediate fill level less than full and corresponding to an adjustment level in said tub said second pressure sensor configured to generate an intermediate fill signal when the intermediate fill level is reached, said first pressure sensor and said second pressure sensor operatively coupled to said hot water valve and said cold water valve, said first pressure sensor generating the full fill signal and said second pressure sensor generating the intermediate fill signal to facilitate activating said hot water valve and said cold water valve in response to sensed pressure within said tub to control a wash water temperature without the aid of temperature sensors.

7. A washing machine in accordance with claim 6 wherein said second pressure sensor generating the intermediate fill signal to close said cold water valve during a hot fill operation.

8. A washing machine in accordance with claim 6 wherein said second pressure sensor generating the intermediate fill signal to open said cold water valve during a hot fill operation.

9. A washing machine in accordance wit claim 8 wherein said second pressure sensor generating the intermediate fill signal to close said hot water valve during a warm fill operation.

10. A washing machine in accordance with claim 8 wherein said second pressure sensor generating the intermediate fill signal to open said hot water valve during a warm fill operation.

11. A washing machine in accordance with claim 6 wherein said first and second pressure sensors are independent.

12. A washing machine in accordance with claim 6 wherein said first and second sensors comprise a single sensor having multiple trip points.

13. A temperature control for a washing machine, the washing machine including a tub, a hot water valve, and a cold water valve, said temperature control comprising:

a first pressure sensor positioned to sense a full fill level in the tub and configured to generate a full fill signal when the tub is full;

a second pressure sensor positioned to sense an intermediate fill level, the intermediate fill level less than the full fill level and corresponding to an adjustment level in the tub, said second pressure sensor configured to generate an intermediate fill signal when the intermediate fill level is reached; and said hot water valve and said cold water valve operatively coupled to said first pressure sensor and said second pressure sensor, at least one of said hot water valve and said cold water valve actuated based on the fill signals generated by said first pressure sensor and said second pressure sensor to control a wash water temperature without the aid of temperature sensors.

* * * * *